United States Patent [19]

Lala

[11] Patent Number: 4,854,294

[45] Date of Patent: Aug. 8, 1989

[54] PRESSURE-ASSISTED BLOW GUN

[76] Inventor: Anthony S. Lala, c/o Unified Concepts, Inc., 1654 Springfield St., Dayton, Ohio 45403

[21] Appl. No.: 131,967

[22] Filed: Dec. 11, 1987

[51] Int. Cl.[4] ..... F41B 1/00

[52] U.S. Cl. ..... 124/62; 124/64; 124/75; 124/82

[58] Field of Search ..... 124/57, 62, 63, 64, 124/71, 73, 75, 74, 82; 604/130

[56] References Cited

U.S. PATENT DOCUMENTS

| | | | |
|---|---|---|---|
| 344,915 | 7/1886 | Lang et al. | 124/62 |
| 2,512,313 | 6/1950 | Dritz | 124/62 X |
| 3,830,214 | 8/1974 | Curtis | 124/57 |
| 4,419,978 | 12/1983 | Loftus | 124/62 |
| 4,467,544 | 8/1984 | Gerwig | 42/1.08 |
| 4,623,145 | 11/1986 | Paraskevakos | 272/135 |
| 4,625,706 | 12/1986 | Turner, Jr. | 124/67 |
| 4,674,470 | 6/1987 | Tsukiji | 124/74 |

FOREIGN PATENT DOCUMENTS

| | | | |
|---|---|---|---|
| 0161298 | 6/1950 | Fed. Rep. of Germany | 124/62 |

*Primary Examiner*—Dave W. Arola
*Assistant Examiner*—Arlen L. Olsen
*Attorney, Agent, or Firm*—Biebel, French & Nauman

[57] ABSTRACT

A hunting or target practice blow gun includes a source of pressurized air or gas and a breath operated valve for connecting the pressurized gas to the blow gun tube to propel a dart or projectile with a force and velocity greater than is possible when using the user's breath alone. No direct connection exists between the mouthpiece and the blow gun tube, and no danger exists of the user swallowing the dart. Target practice darts of 10 to 15 grains may be shot up to 1000 ft. using a canister of gas pressurized to 120 psi.

19 Claims, 3 Drawing Sheets

42
34
36
32

20
34
52
32
33
16
10
14
44
60
S
84
T
82
L
62
V
86
88
90
94
92
108
100
112
S
106
110
102
104
114
116

PRESSURE-ASSISTED BLOW GUN

BACKGROUND OF THE INVENTION

The present invention relates to blow guns, and more particularly, to mouth-activated blow guns.

Blow guns are commonly used for driving projectiles. For example, U.S. Pat. No. 3,901,158 teaches that blow guns can be used for firing drug-filled projectiles at animals.

A typical dart blow gun for shooting darts is shown in U.S. Pat. No. 4,419,978 and *Popular Science* 131 (March 1987). Such dart blow guns comprise a mouthpiece and a blow gun tube wherein the mouthpiece is in communication with the blow gun tube. To use the dart blow gun, a user inserts a dart through the mouthpiece into the blow gun tube. The user then blows into the mouthpiece to blow the dart out of the blow gun tube.

Because the user's breath is propelling the dart, such dart blow guns have a limited firing range. Also, because the mouthpiece is in communication with the blow gun tube, the possibility always exists that a user will swallow a dart after loading it into the gun.

As such, a need exists for a blow gun for propelling darts wherein the gun has a long distance firing range and eliminates the possibility of a user swallowing a dart in normal operations.

SUMMARY OF THE INVENTION

The present invention fulfills the need in the industry by providing a blow gun wherein a greater air pressure is exerted on the projectiles so that the gun has a long distance range. The pressure-assisted blow gun comprises a blow gun tube having a loading end and a discharge end, a mouthpiece having a duct in communication with the blow gun tube, and means for loading a projectile into the loading end of the blow gun tube. Unlike known blow guns, the present blow gun also includes means responsive to a user's breath for providing air to blow a projectile loaded into the loading end of the blow gun tube out of the discharge end of the blow gun tube with a greater pressure than that of a user's breath alone. Such responsive means allows the blow gun to be used over a long distance firing range.

Also unlike known blow guns, the present blow gun preferably includes means for preventing a projectile loaded into the loading end of the blow gun tube from entering the mouthpiece; normally with the present blow gun, a user cannot swallow a projectile after loading it into the loading end of the blow gun tube.

The blow gun of the present invention is useful for target practice including turkey shoots and hunting. The heavy impact of the projectiles allows the blow gun to be used for hunting large game. The blow gun is also useful for spear fishing. Unlike firearms, blow guns can be used for hunting for 12 months per year. Although the blow gun is designed to be used with darts, other projectiles such as arrows, drug-filled projectiles, and spears may be used therein. The present blow gun may be useful in military operations because firing of the gun is quiet.

Thus, objects of the present invention are to provide a blow gun which is mouth-activated, has a long distance range, has means for preventing a user from swallowing a dart therein, has means for holding a dart therein when the gun is in a non-horizontal position, and is portable.

Other objects and advantages of the invention will be apparent from the following description, the accompanying drawings, and the appended claims.

DETAILED DESCRIPTION OF THE PREFERRED EMBODIMENTS

Figures 1, 5:
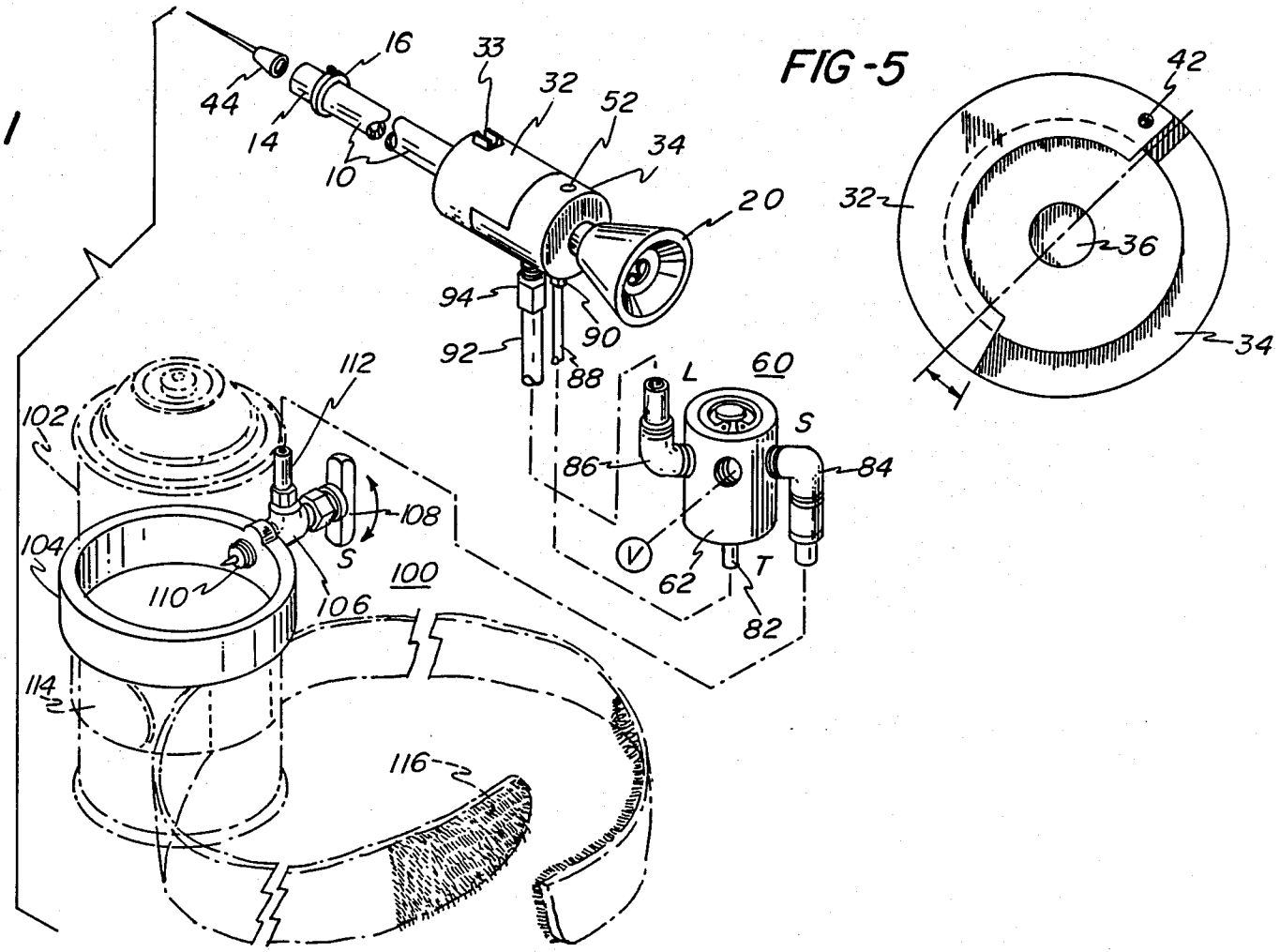
FIG. 1 is a three-quarters view of the blow gun of the present invention.
FIG. 5 is a cross-sectional view of the main body portion of FIG. 1.
Figure 2:
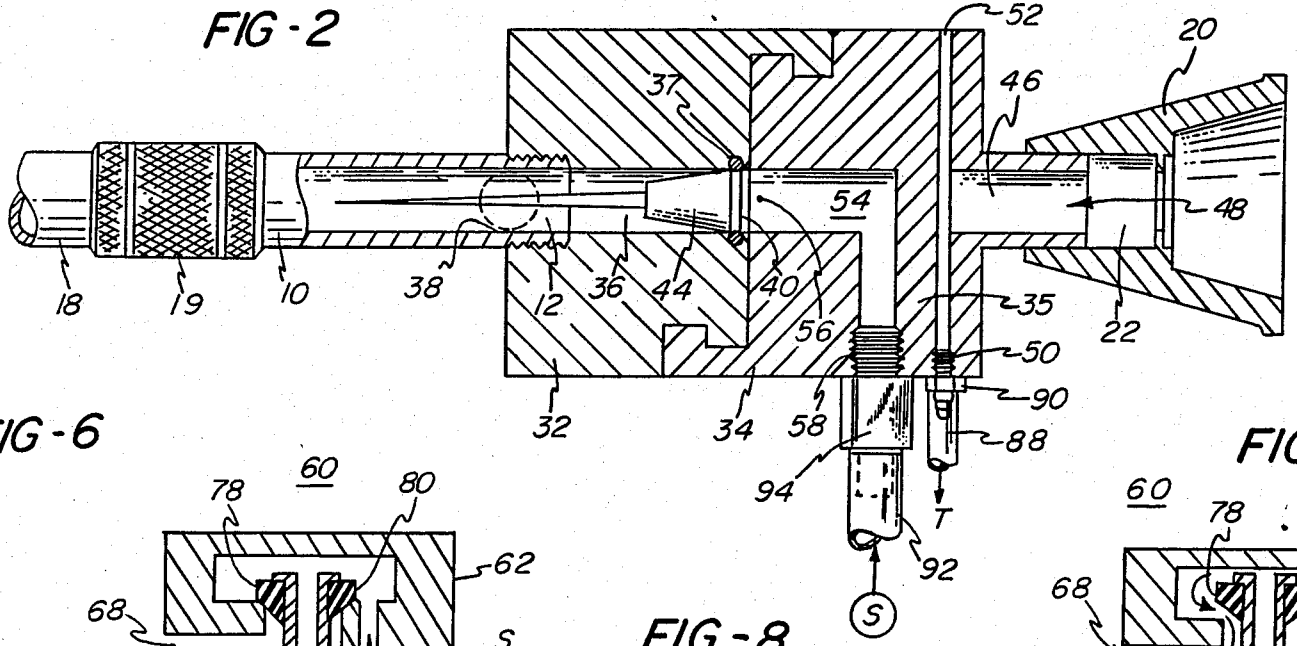
FIG. 2 is a side view in cross section of the main body portion of the blow gun of FIG. 1.

FIG. 1 shows the blow gun of the present invention. The blow gun tube 10 comprises a loading end 12 and a discharge end 14. Referring to FIG. 2, the mouthpiece 20 has a duct 22 which is in communication with the blow gun tube 10.

The present blow gun also includes means for loading a projectile into the loading end 12 of the blow gun tube 10. As shown in FIG. 2, the loading means comprises two sections 32 and 34. The first section 32 has a passage 36 having a first external opening 38 and a second external opening 40. The passage 36 communicates at the first external opening 38 with the loading end 12 of the blow gun tube 10. Typically, the blow gun tube 10 is threaded on one end thereof so that it screws into the threads of the first external opening 38 of the passage 36.

Figure 3:
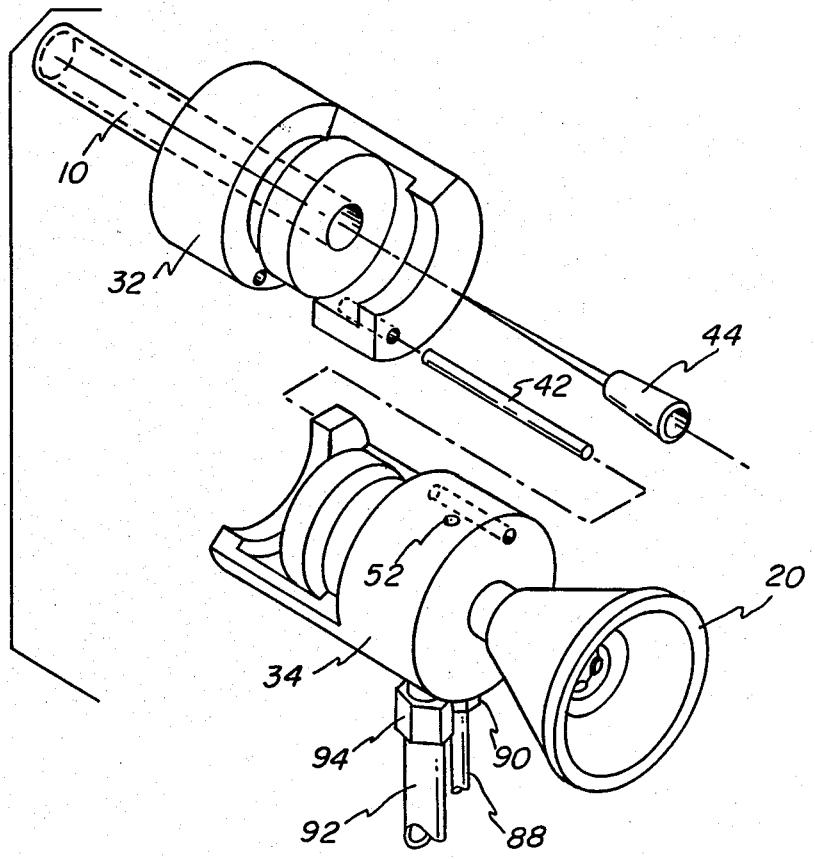
FIG. 3 is a three-quarters view of the main body portion, partially exploded, of the blow gun of FIG. 1.

Referring to FIGS. 2, 3, and 5, the two sections 32 and 34 interlock with each other. The two sections 32 and 34 are hinged along the length of one side of the sections by a pin 42 so that the sections 32 and 34 can be rotated away from each other but not longitudinally separated. As seen best in FIG. 3, the sections 32 and 34 can be rotated away from each other for the insertion of a projectile 44 into the loading end 12 of the blow gun tube 10.

Referring to FIG. 2, the second section 34 has a first passage 46 with a first external opening 48, a second external opening 50, and a third external opening 52. The second section 34 also has a second passage 54 with a first external opening 56 and a second external opening 58. The second passage 54 at the first external opening 56 is in gas communication with the second external opening 40 of the passage 36 of the first section 32.

Figure 4:
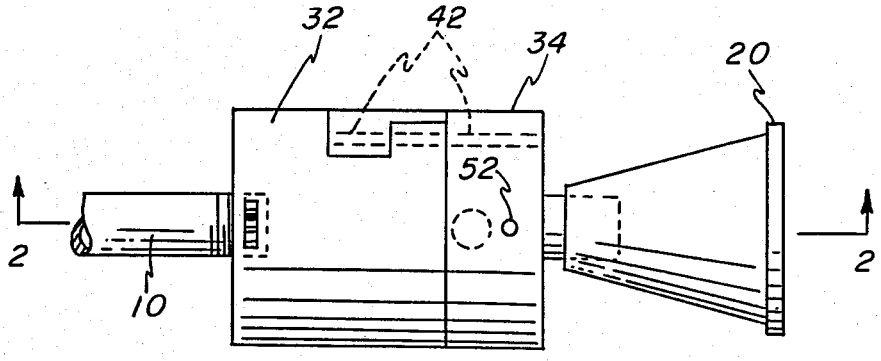
FIG. 4 is a top view of the main body portion of the blow gun of FIG. 3.

The first passage 46 of the second section 34 communicates at the first external opening 48 with the duct 22 of the mouthpiece 20. Although the mouthpiece 20 can be located at numerous positions relative to the blow gun tube 10, preferably, the mouthpiece 20 is axially aligned with the blow gun tube 10. As seen best in FIG. 4, the third external opening 52 of the first passage 46 serves as an air exhaust passage.

The pressure-assisted blow gun includes means responsive to a user's breath for providing gas to blow a projectile 44 loaded into the loading end 12 of the blow gun tube 10 out of the discharge end 14 of the blow gun tube 10 with a greater pressure than that of a user's breath alone. As shown in FIG. 1, the responsive means comprises a valve portion 60 connected to the second section 34 and a source of pressurized gas 100 connected to the valve portion 60. A useful valve portion 60 is commercially available from Clippard Minimatic as Fluidamp Valve 2010; a minimum of four ounces of human breath is required to activate such a valve portion 60.

Figure 6:
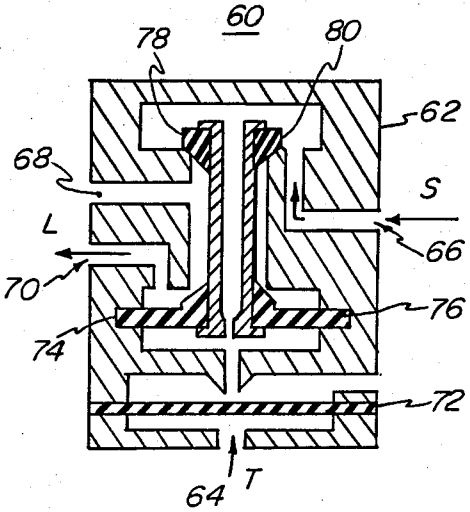
FIG. 6 is a cross-sectional view of the valve portion in a closed position of FIG. 1.

FIG. 6 shows a cross-sectional view of the valve portion 60 of FIG. 1 wherein the valve is in a closed position. The valve portion 60 assumes this position when a user is not blowing into the mouthpiece 20. The valve portion 60 comprises a cylinder 62 having passages therein. The valve portion 60 has a first external opening 64 which is the trigger opening, a second external opening 66 which is the source opening, a third external opening 68 which is the load opening, and a fourth external opening 70 which is the exhaust opening. When seal 72 is in the position shown in FIG. 6, seals 74, 76, 78, and 80 are positioned as shown to prevent gas from flowing from a supply source into the source opening 66 and out the loading opening 68.

Figure 7:
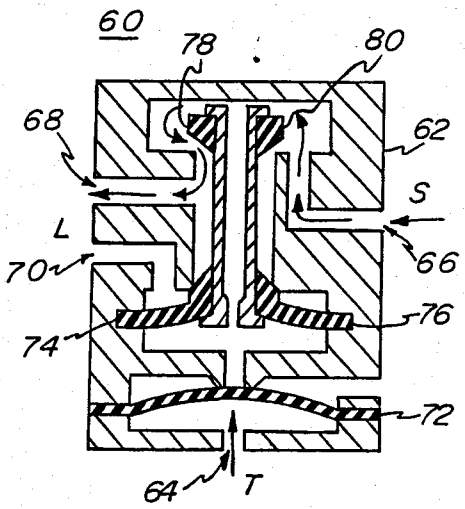
FIG. 7 is a cross-sectional view of the valve portion in an open position of FIG. 1.

FIG. 7 shows a cross-sectional view of the valve portion 60 of FIG. 1 wherein the valve is in an open position. The valve portion 60 assumes this position when a user is blowing into the mouthpiece 20. When seal 72 is depressed as shown due to the user's breath passing into the trigger opening 64, seals 74, 76, 78, and 80 are positioned as shown to allow gas to flow from a supply source into the source opening 66, through the passage as shown by the arrows, and out the load opening 68. The exhaust opening 70 serves as a safety relief.

As shown in FIG. 1, a trigger connection 82 has one end which is threaded to screw into the threads of the trigger opening 64. A source connection 84 has one end which is threaded to screw into the threads of the source opening 66. A load connection 86 has one end which is threaded to screw into the threads of the load opening 68.

As shown in FIGS. 1–3, a trigger hose 88 is connected to the second section 34 and communicates with the first passage 46 at the second external opening 50 thereof. The trigger hose 88 is connected to the second section 34 by a threaded connection 90 which screws into the threads of the second external opening 50 of the first passage 46. The second end of the trigger connection 82 fits into trigger hose 88.

The load hose 92 is connected to the second section 34 and communicates with the second passage 54 at the second external opening 58 thereof. The load hose 92 is connected to the second section 34 by a threaded connection 94 which screws into the threads of the second external opening 58 of the second passage 54. The second end of the load connection 86 fits into load hose 92.

The source of pressurized gas 100 is connected to the valve portion 60. The source of pressurized gas 100 comprises a standard canister of pressurized gas 102 held in a ring 104 which surrounds the canister. Useful sources of pressurized gas include freon such as F12 and F22, carbon dioxide, nitrogen, and propane. An average source is useful for about 50 shots. Typically, the canister of pressurized gas 102 is at a pressure of about $4.2\times10^4$ to $2.1\times10^5$ kilograms per square meter (60 to 300 pounds per square inch).

A self-puncturing valve 106 is connected to the ring 104 and communicates with the canister of pressurized gas 102. The self-puncturing valve 106 has a handle 108 thereon so that upon turning the handle 108, the pin 110 punctures the canister of pressurized gas 102 and gas flows out of the canister, into the valve, and out of the source outlet 112. The source outlet 112 communicates with the source connection 84. Typically, the canister of pressurized gas 102 supplies pressurized gas to projectiles 44 at about $4.2\times10^4$ to $2.1\times10^5$ kilograms per square meter (60 to 300 pounds per square inch).

For convenience in transporting the pressure-assisted blow gun of the present invention, a double-loop strap 114 can be used. The first loop of the strap 114 surrounds the canister 102; the ends of the first loop are connected by a fastener such as VELCRO TM commercially available from VELCRO TM U.S.A. Inc. The second loop of the strap 114 can surround the user's waist; the ends of the second loop are connected by a strip 116 of VELCRO TM.

To operate the pressure-assisted blow gun, a user rotates the sections 32 and 34 apart, loads a projectile 44 into the passage 36, and rotates the sections 32 and 34 back together. The user then aims the gun by looking through the sight 33 on the first section 32 and the sight 16 on the blow gun tube 10 at a target and blows into the mouthpiece 20. The user's breath flows into the mouthpiece 20, through the duct 22, through the first passage 46, through the trigger hose 88, and into the trigger connection 82 of the valve portion 60. As a result, air flows from the canister of pressurized gas 102, into the self-puncturing valve 106, out the source outlet 112, into the source conection 84, through the passage of the valve portion 60 as indicated by the arrows in FIG. 7, out the load connection 86, through the load hose 92, through the second passage 54 of the second section 34, and through the passage 36 of the first section 32 to blow the projectile 44 out of the pressure-assisted blow gun. Unlike firearms, the operation of the blow gun is quiet and does not scare animals away.

As those skilled in the art can appreciate, known darts are too light to be used in the present blow gun; known darts bend upon impact when released from the present gun. As such, the present blow gun uses darts of 10 to 15 grains.

Figure 8:
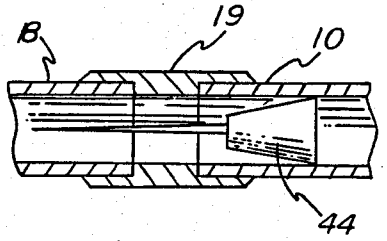
FIG. 8 is a cross-sectional view through the blow gun tube and connection of FIG. 2.

In order to provide a blow gun tube 10 having a greater length, the blow gun tube 10 can have an extension 18 thereon by means of a connection 19 as shown in FIG. 2 so that greater firing distances can be achieved. As shown in FIG. 8, the inner diameters of the blow gun tube 10, the connection 19, and extension 18 are equal.

The firing range over which a kill can be achieved depends upon the pressure of the gas and the length of the blow gun tube. For example, with a gas pressure of 120 pounds per square inch and a tube length of nine feet, kill can be achieved at 1000 feet. This firing range is three times greater than that achieved with known blow guns.

With a low gas pressure and a short blow gun tube length, the pressure-assisted blow gun can be used inside for target practice. For example, a gas pressure of 60 pounds per square inch and a tube length of three feet are useful conditions for target practice.

Unlike previous dart blow guns wherein a dart can possibly be swallowed, one safety feature of the present invention involves means for preventing a projectile 44 loaded into the loading end 12 of the blow gun tube 10 from entering the mouthpiece 20. Preferably, the preventing means comprises a wall 35 between the first passage 46 and the second passage 54 of the second section 34 as shown in FIG. 1. Because wall 35 separates the mouthpiece duct 22 and the loading end 12 of the blow gun tube 10 so as to prevent movement of a projectile 44 therebetween, a user cannot swallow a projectile 44 loaded into the loading end 12 of the blow gun tube 10.

Referring specifically to FIG. 2, another safety feature of the present invention is an O-ring 37 which is fitted in the passage 36. The O-ring 37 prevents a projectile 44 from falling out of the blow gun tube 10. As such, unlike known blow guns, when the pressure-assisted blow gun is in a non-horizontal position, the projectile 44 does not fall out of the blow gun tube 10.

If the canister of pressurized gas 102 is exhausted and another canister is unavailable, the mouthpiece 20 can be removed from the second section 34 and the blow gun tube 10 can be removed from the first section 32. The mouthpiece 20 can then be connected to the blow gun tube 10 so as to create a gun comparable to known blow guns.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A pressure-assisted blow gun comprising:

a blow gun tube comprising a loading end and discharge end;

a mouthpiece having a duct in communication with said blow gun tube;

means for loading a projectile into said loading end of said blow gun tube;

a source of pressurized gas; means for communicating said source of pressurized gas with said blow gun tube; and means responsive to a user's breath for utilizing said source of pressurized gas to blow a projectile loaded into said loading end of said blow gun tube out of said discharge end of said blow gun tube with a greater velocity than is available from the user's breath alone.

2. The pressure-assisted blow gun of claim 1 wherein said mouthpiece is axially aligned with said blow gun tube.

3. The pressure-assisted blow gun of claim 1 wherein said loading means comprises a first and second section, said first section having a passage having a first external opening and a second external opening wherein said passage communicates at said first external opening with said loading end of said blow gun tube.

4. The pressure-assisted blow gun of claim 3 wherein said two sections interlock with each other.

5. The pressure-assisted blow gun of claim 4 wherein said first and second sections are hinged along the length of one side of said sections so that said sections can be rotated away from each other but not longitudinally separated for the insertion of a projectile into said loading end of said blow gun tube.

6. The pressure-assisted blow gun of claim 5 wherein said second section has a first passage with three external openings and a second passage with two external openings wherein said second passage at the first external opening is in gas communication with said second external opening of said passage of said first section.

7. The pressure-assisted blow gun of claim 6 wherein said first passage of said second section communicates at said first external opening with said duct of said mouthpiece.

8. The pressure-assisted blow gun of claim 3 which additionally comprises means for preventing a projectile loaded into said loading end of said blow gun tube from entering said mouthpiece.

9. The pressure-assisted blow gun of claim 8 wherein said preventing means comprise a wall between said first and second passages of said second section.

10. The pressure-assisted blow gun of claim 3 wherein said responsive means comprises:

a valve portion connected to said second section; and said source of pressurized gas connected to said valve portion.

11. The pressure-assisted blow gun of claim 3 wherein said passage of said first section has an O-ring fitted therein.

12. The pressure-assisted blow gun of claim 10 wherein said source of pressurized gas comprises:

a canister of pressurized gas;

a ring surrounding said canister; and a self-puncturing valve connected to said ring and communicating with said canister.

13. The pressure-assisted blow gun of claim 12 wherein said canister of pressurized gas is at a pressure of about $4.2\times10^4$ to $2.1\times10^5$ kilograms per square meter (60 to 300 pounds per square inch).

14. The pressure-assisted blow gun of claim 13 wherein said canister of pressurized gas supplies pressurized gas to projectiles at about $4.2\times10^4$ to $2.1\times10^5$ kilograms per square meter (60 to 300 pounds per square inch).

15. In a blow gun which propels darts, said gun comprising a blow gun tube and a mouthpiece, the improvement comprising:

means for preventing a projectile loaded into said loading end of said blow gun tube from entering said mouthpiece;

a source of pressurized gas; means for communicating said source of pressurized gas with said blow gun tube; and means responsive to a user's breath for utilizing said source of pressurized gas to blow a projectile loaded into said loading end of said blow gun out of said discharge end of said blow gun tube with a greater pressure than that of a user's breath alone.

16. The improvement of claim 15 wherein said responsive means comprises:

a valve portion connecting said blow gun tube;

to said source of pressurized gas.

17. The improvement of claim 15 wherein said source of pressurized gas comprises:

a canister of pressurized gas;

a ring surrounding said canister; and a self-puncturing valve connected to said ring and communicating with said canister.

18. The improvement of claim 17 wherein said canister of pressurized gas is at a pressure of about $4.2\times10^4$ to $2.1\times10^5$ kilograms per square meter (60 to 300 pounds per square inch).

19. The improvement of claim 18 wherein said canister of pressurized air supplies pressurized air to projectiles at about $4.2\times10^4$ to $2.1\times10^5$ kilograms per square meter (60 to 300 pounds per square inch).

* * * * *